United States Patent [19]

Jahel

[11] Patent Number: 4,516,681

[45] Date of Patent: May 14, 1985

[54] COLLAPSIBLE DISPLAY HANGER FOR PERFORATED DISPLAY PANELS

[76] Inventor: Alfred Jahel, 500 Deguire, Ville St-Laurent, Quebec, Canada X, H4L 1L2

[21] Appl. No.: 365,233

[22] Filed: Apr. 5, 1982

[51] Int. Cl.[3] ..... A47F 5/13

[52] U.S. Cl. ..... 211/59.1; 211/104; 211/106; 248/220.4

[58] Field of Search ..... 211/59.1, 57.1, 54.1, 211/104, 106, 87; 248/220.3, 220.4, 222.2, 221.4

[56] References Cited

U.S. PATENT DOCUMENTS

| | | | |
|---|---|---|---|
| 2,797,817 | 7/1957 | Shugarmon | 248/221.1 X |
| 3,198,469 | 8/1965 | Callanan | 248/220.4 |
| 3,289,994 | 12/1966 | Burmeister | 248/220.4 |
| 4,351,440 | 9/1982 | Thalenfeld | 248/220.4 X |

FOREIGN PATENT DOCUMENTS

| | | | |
|---|---|---|---|
| 2331906 | 1/1974 | Fed. Rep. of Germany | 248/220.4 |
| 2386718 | 12/1978 | France | 248/220.4 |
| 1483450 | 8/1977 | United Kingdom | 248/220.4 |

*Primary Examiner*—Robert W. Gibson, Jr.
*Attorney, Agent, or Firm*—Swabey, Mitchell, Houle, Marcoux & Sher

[57] ABSTRACT

The invention is concerned with a collapsible display hanger for detachable engagement with a perforated display panel provided with regularly spaced perforations arranged in horizontal and vertical rows. The display hanger of the invention comprises a hanger member having an elongate hanger arm adapted to extend outwardly from the panel and substantially perpendicular to the plane thereof, in a normal merchandise display position, and a bracket member adapted to be removably anchored to the panel through a pair of horizontally disposed perforations. A hinge means slidably interconnects the hanger member with the bracket member for pivotal movement of the hanger arm about a pivot axis between the normal display position and a collapsed position whereat the hanger arm lies closely adjacent the panel. The hanger member is slidably engaged with the bracket member for shifting displacement of the hanger member in a direction parallel with the pivot axis such that the hanger arm clears an adjacent display hanger disposed in the pivotal path thereof when the hanger arm is pivotally moved to the collapsed position. The hanger member and the bracket member also cooperate together upon disengagement of the bracket member from the panel to provide an articulation of the bracket member about a horizontal axis such that the bracket member is released from the panel in an arcuate movement while the hanger arm is maintained substantially perpendicular to the plane of the panel.

15 Claims, 11 Drawing Figures

COLLAPSIBLE DISPLAY HANGER FOR PERFORATED DISPLAY PANELS

BACKGROUND OF THE INVENTION

The present invention relates to display hangers for detachable engagement with a perforated display panel generally known as a Peg Board, which is provided with regularly spaced perforations arranged in horizontal and vertical rows.

The hangers with which the invention is concerned are generally used for the display of carded or bagged merchandise and comprise a hanger member having an elongate hanger arm adapted to extend outwardly from the panel and substantially perpendicular to the plane thereof for supporting the articles to be displayed, the hanger member being connected to a bracker member adapted to be removably anchored to the panel through a pair of horizontally disposed perforations. The invention is more particularly directed to such a display hanger in which the hanger member and bracket member are pivotally coupled together so as to enable the unit as a whole to be engaged with or disengaged from the panel without tilting the hanger arm to an extent that would disturbe upwardly adjacent units or their contents.

It is apparent that a horizontally projecting rod such as the hanger arm component of the above display hanger when it is empty presents a hazard since it is most often hidden from view by the merchandise displayed by adjacent units. Accidents have indeed occured as a result of persons bending forward to pick-up a displayed article and inadvertently colliding with such a hidden hanger arm, causing bodily injuries particularly to the head.

The prior art in connection with such display hangers is, in general, well developed and many varieties thereof are commercially available on the market. None of the commercially available hangers, however, obviate the above-mentioned problem in a simple, convenient and economic manner.

In U.S. Pat. No. 4,146,204 of Mar. 27, 1979, for instance, there is described a foldable display hanger in which the hanger arm is pivotally connected to a mounting bracket removably anchored to a display panel for vertical pivotal movement of the hanger arm between a display position whereat the hanger arm extends outwardly from the panel and a retracted position whereat it is folded upward to lie flat against the panel. The hanger arm is constructed of a generally U-shaped wire, the ends of which are bent to form pivot shafts. These pivot shafts are received in axially aligned openings formed in spaced apart side plates of the mounting bracket, to provide for the desired pivotal mounting of the display hanger. A supporting bar extends between the lower front edge portions of the respective side plates and serves to rigidly support the hanger arm in its extended position.

Although the primary purpose of the foldable display hanger described in U.S. Pat. No. 4,146,204 is to provide preassembled display panels on which the display hangers are prearranged in the folded position and thus in a highly compact form for shipment to a merchandise retail store at minimum cost, it is apparent that the proposed display hangers when they are empty in the retail store can be folded so as to prevent the hanger arms from causing injuries to customers or catching in customers' garments. A major drawback of such a construction, however, is that it requires significant overhead clearance so as to permit the hanger arm to swing upwardly to the vertical folded position. Thus, it cannot be used where the merchandise to be displayed must be arranged in closely spaced vertical rows, as is often the case, since the presence of an upwardly adjacent unit located in the pivotal path of the hanger arm as it is swung upwardly will interfer with its pivotal movement and prevent it from being folded against the panel. Also, since the bar rigidly supporting the hanger arm in the outwardly extended position prevents the mounting bracket from pivoting about a horizontal axis relative to the hanger arm, such a foldable display hanger has a further disadvantage that it cannot be engaged with or disengaged from the panel in the manner described, for instance, in U.S. Pat. Nos. 3,275,272 and 3,289,993, which enables the mounting bracket to be anchored to or release from the panel in an arcuate movement while the hanger arm is maintained substantially perpendicular to the plane of the panel, so as to avoid disturbing upwardly adjacent units or their contents.

SUMMARY OF THE INVENTION

It is therefore an object of the present invention to overcome the above-mentioned drawbacks and to provide a collapsible display hanger in which the hanger arm can be pivotally moved to lie flat against the panel despite the presence of adjacent interferring units, and which can engaged with or disengaged from the panel without disturbing upwardly adjacent units or their contents, in a simple and convenient manner.

In accordance with the invention, there is thus provided a collapsible display hanger for detachable engagement with a perforated display panel provided with regularly spaced perforations arranged in horizontal and vertical rows, comprising a hanger member having an elongate hanger arm adapted to extend outwardly from the panel and substantially perpendicular to the plane thereof, in a normal merchandise display position, and a bracket member adapted to be removably anchored to the panel through a pair of horizontally disposed perforations. A hinge means slidably interconnects the hanger member with the bracket member for pivotal movement of the hanger arm about a pivot axis between the normal display position and a collapsed position whereat the hanger arm lies closely adjacent the panel. The hanger member is slidably engaged with the bracket member for shifting displacement of the hanger member in a direction parallel with the pivot axis such that the hanger arm clears an adjacent display hanger disposed in the pivotal path thereof when the hanger arm is pivotally moved to the collapsed position. The hanger member and the bracket member also cooperate together upon disengagement of the bracket member from the panel to provide an articulation of the bracket member about a horizontal axis such that the bracket member is released from the panel in an arcuate movement while the hanger arm is maintained substantially perpendicular to the plane of the panel.

According to a first preferred embodiment of the invention, the hanger member is L-shaped and includes a coupling arm disposed at substantially right angle to the hanger arm and the bracket member comprises a mounting plate provided with anchoring means at an upper portion thereof. The hinge means, on the other hand, comprises a pair of upper and lower sleeve portions arranged on the mounting plate for engaging the coupling arm on opposite sides thereof so as to enable the hanger arm to pivot about a vertical axis while allowing the coupling arm to slidably move along the vertical axis whereby the hanger member is moved from the normal display position to the collapsed position by upwardly displacing the hanger member and horizontally swinging the hanger arm to lie closely adjacent the panel. The sleeve portions are disposed relative to one another such that upon disengagement of the mounting plate from the panel an edge of the lower sleeve portion abuts a portion of the coupling arm whereby to permit the mounting plate to be articulated about the coupling arm portion. In this embodiment, the display hanger further includes means for releasably locking the hanger member in the normal display position.

According to a second preferred embodiment, the hanger member further has a connecting end portion comprising an abutment leg angularly disposed to the hanger arm and the bracket member is U-shaped and includes a pair of spaced parallel upwardly extending L-shaped hook arms adapted for passage through the horizontal perforations and abutment against a rear surface of the panel; a horizontally extending base interconnects the hook arms. The hinge means comprises a hinge socket formed at the connecting end portion of the hanger member and receiving a portion of the base in slidable snap-fit engagement so as to enable the hanger arm to pivot about a horizontal axis while allowing the connecting end portion to slidably move along the base in a direction parallel with the horizontal axis whereby the hanger arm is moved from the normal display position whereat the abutment leg downwardly extends in abutting engagement with a front surface of the panel to maintain the hanger arm forwardly extended, to the collapsed position whereat the leg is disengaged from the front surface by horizontally displacing the hanger member and upwardly swinging the hanger arm to lie closely adjacent the panel. The base portion is axially rotatable within the hinge socket when the bracket member is engaged with or disengaged from said panel whereby to permit the bracket member to be articulated relative to the hanger member.

Thus, by first upwardly displacing the hanger member of the first embodiment or horizontally displacing that of the second embodiment and then by horizontally or upwardly swinging the hanger arm to lie substantially flat against the panel, it is possible to move the hanger arm to the collapsed position while clearing an adjacent unit positioned in the same horizontal or vertical row as the display hanger to be collapsed. The collapsible display hanger of the invention therefore enables one to display the merchandise in closely spaced horizontal and vertical rows, thereby minimizing loss of valuable display space.

In either embodiment, the hanger member is preferably detachable from the bracket member in a manner which enables the bracket member to remain anchored to the panel. This has the advantage of permitting the hanger member to be changed for another having a hanger arm of either shorter or longer length and, since the bracket member remains on the panel and thus provides an indication of the exact display position, the new hanger member of different length can be readily repositioned on the panel to occupy its original display position.

BRIEF DESCRIPTION OF THE DRAWINGS

Further advantages and features of the invention will become apparent from the following detailed description of preferred embodiments thereof as illustrated by way of examples in the accompanying drawings, in which.

DESCRIPTION OF PREFERRED EMBODIMENTS

Figure 1:
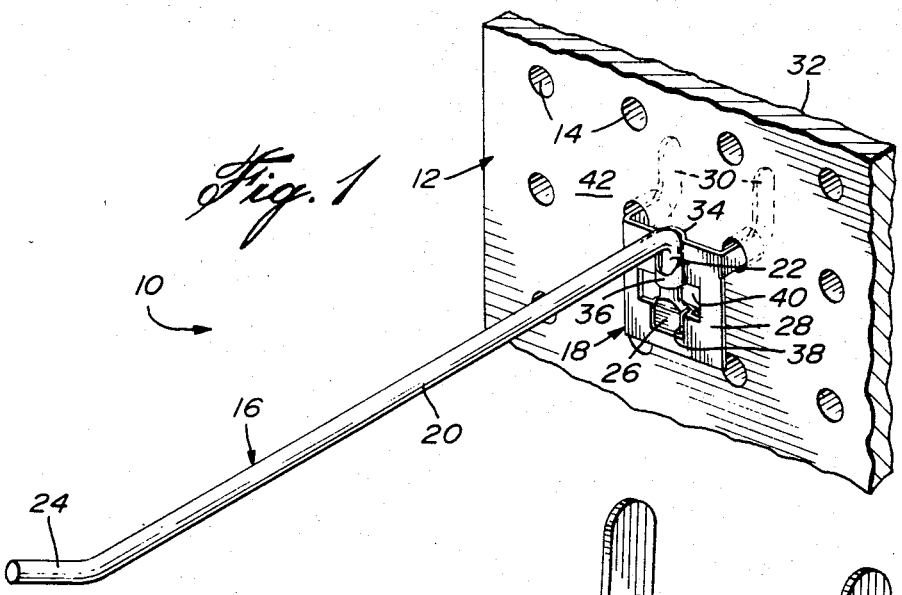
FIG. 1 is a prespective view of a collapsible display hanger according to a first preferred embodiment of the invention, as seen mounted on a display panel in a normal display position.
Figure 2:
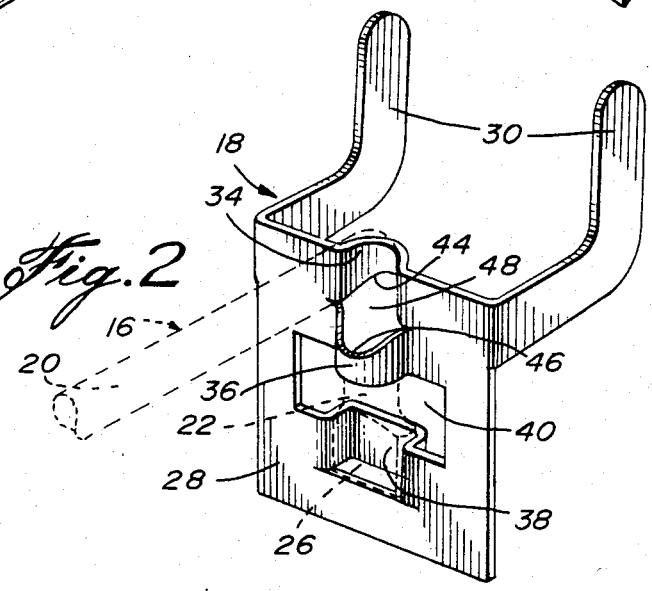
FIG. 2 is an enlarged perspective view of the bracket member of the display hanger shown in FIG. 1.
Figure 3:
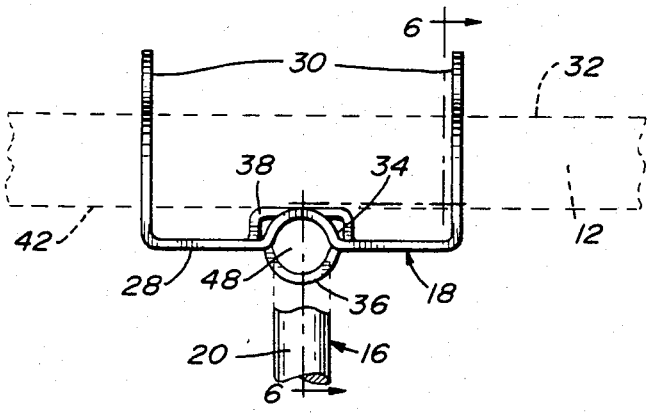
FIG. 3 is a fragmentary top view of the display hanger of FIG. 1, with the display panel shown in broken lines.

Referring first to FIGS. 1–6 of the drawings, and more particularly to FIGS. 1–3 thereof, there is illustrated a collapsible display hanger generally designated by reference numeral 10 and mounted on a perforated display panel or so-called Peg Board 12 which is provided with regularly spaced perforations 14 arranged in horizontal and vertical rows. The display hanger 10 comprises an L-shaped wirelike metallic hanger member 16 hingedly connected to a bracket member 18.

The hanger member 16 has an elongate hanger arm 20 extending outwardly from the panel 12 and substantially perpendicular to the plane thereof in the normal display position shown in FIG. 1, and an angularly bent coupling arm 22 disposed at substantially right angle to the hanger arm 20. The hanger arm typically has an upwardly bent free end portion 24 for assisting in retaining articles on the arm 20. The coupling arm 22, on the other hand, is provided with a spaded end 26, the purpose of which will be explained hereinbelow.

The bracket member 18 comprises a mounting plate 28 made of thin sheet metal and having at an upper portion thereof a pair of spaced parallel rearwardly and upwardly extending L-shaped hook fingers 30 adapted for passage through a pair of adjacent horizontally disposed perforations 14 and abutment against the rear surface 32 of the panel 12. The mounting plate 28 further has a pair of upper and lower sleeve portions 34 and 36 integrally formed therein and protruding respectively rearwardly and forwardly from the plate. The sleeve portions 34 and 36 engage the coupling arm 22 on opposite sides thereof in a manner such as to enable the hanger arm 20 to pivot about a vertical axis while allowing the coupling arm 22 to slidably move along the same vertical axis. In order to releasably lock the hanger arm 20 in its normal display position, a rearwardly protruding pocket 38 is formed in the mounting plate 28 below the sleeve portion 36 and is shaped to receive the spaded end 26 of the coupling arm 22 in press-fit engagement. As shown, the spaded end 26 is disposed in the pocket 38 in a manner such that its plane lies parallel with the plane of the mounting plate. A central aperture 40 is also provided between the lower sleeve portion 36 and the pocket 38 for clearing the spaded end 26 when it is disengaged from the pocket. The upper sleeve portion 34 and pocket 38 abut against the front surface 42 of the panel so as to space the mounting plate 28 from the panel front surface, as best shown in FIG. 3.

The sleeve portions 34 and 36 have complementary contoured edges 44 and 46 defining an angularly inclined elliptical opening 48, when viewed facing the mounting plate 28, as best shown in FIG. 2. The elliptical opening 48 is inclined at an angle of about 45°, when viewed in the plane of the mounting plate. It has a length sufficient to allow the passage of the spaded end 26 of the coupling arm 22 when the plane of the spaded end is aligned with the longitudinal axis of the opening 48. Thus, by first grasping the hanger arm 20 and raising the hanger member 16 so as to upwardly displace the coupling arm 22 and to thereby dislodge the spaded end 26 thereof from the pocket 38, and then by horizontally swinging the hanger arm 20 through an arc of about 90° to correspondingly rotate the spaded end within the aperture 40 such that its plane if aligned with the longitudinal axis of the opening 48 and thereafter tilting the arm 22 through an angle of about 45° within the opening 48 which provides a clearance for the arm 22 as it is tilted, it is possible to withdraw the spaded end from the opening and to thereby detach the hanger member 16 from the bracket member 18 while the latter remains anchored to the panel 12. As previously mentioned, this enables one to change the hanger member 16 for one having a hanger arm 20 of different length, which can then be readily repositioned to its original display position since the bracket member 18 which remains anchored to the panel serves a marker indicating the exact display position.

Figure 4:
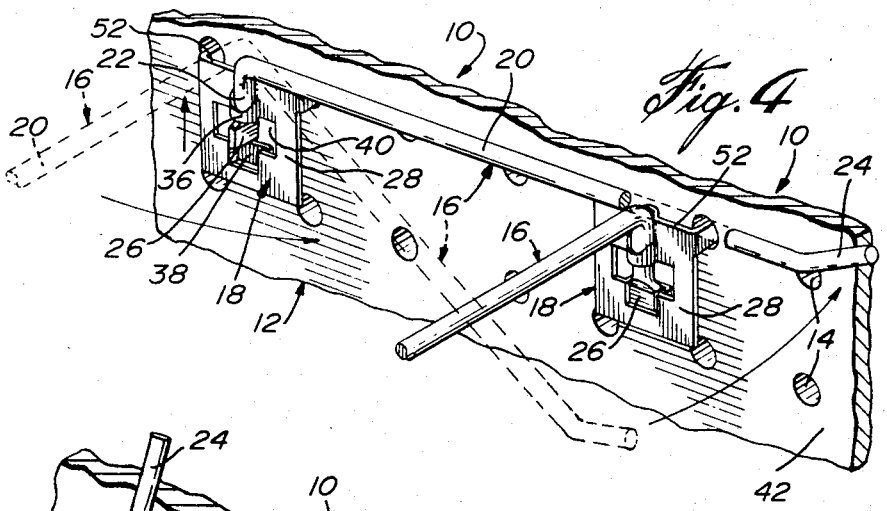
FIG. 4 is another perspective view showing how the hanger arm of the display hanger is moved from its normal display position to the collapsed position while clearing an adjacent unit positioned in the same horizontal row.
Figure 6:
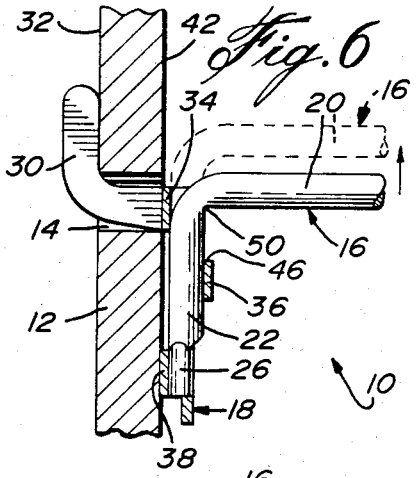
FIGS. 6 and 6A are sectional views taken along line 6—6 of FIG. 3.

As shown in FIG. 4, the hanger arm 20 of the display hanger 10 can be conveniently moved from its normal display position to the collapsed position whereat it lies closely adjacent the panel front surface 42 by first raising the hanger member 16 to dislodge the spaded end 26 from the pocket 38 and at the same time to upwardly shift the hanger arm 20 to a higher level relative to an adjacent unit 10 positioned on the same horizontal row, as shown in broken lines. Then, the hanger arm 20 is swung horizontally through an arc of about 90° to lie flat against the panel, the arm 20 thus passing over the hanger arm of the adjacent unit and clearing same. The hanger member 16 is advantageously provided with a right angularly bent inner junction portion 50 defined between its hanger arm 20 and coupling arm 22, as best shown in FIG. 6, so as to enable the arm 20 once in the collapsed position to rest in a stable manner on the upper edge portion 52 of the plate 28 which is located on either side of the upper sleeve portion 34 as well as on the portion of the respective hook finger 30 which protrudes from the panel front surface 42, the outer end portion of the arm 20 resting in a similar manner upon the bracket member 18 of the adjacent unit 10. The upper edge portion 52 of the mounting plate and the adjacent portion of the respective hook finger 30 thus defines a resting abutment for supporting the hanger arm 20 in the collapsed position.

Figure 5:
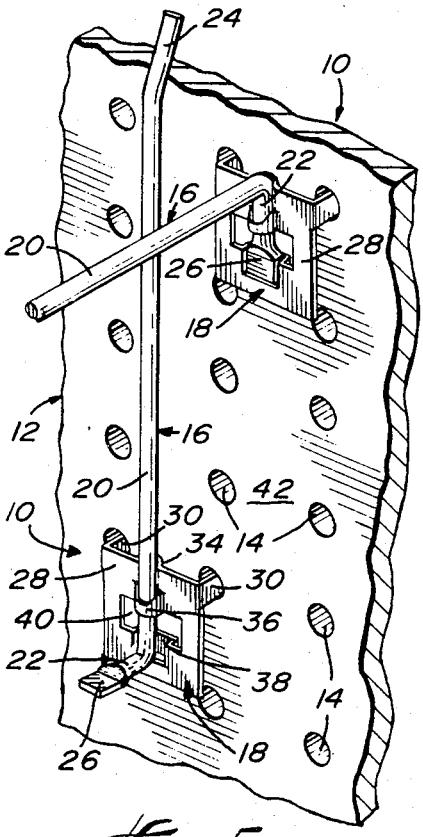
FIG. 5 is a further perspective view showing the hanger arm in an upwardly extended position and lying flat against the panel.

When an upwardly adjacent unit 10 is not arranged in the same vertical row as the display hanger to be collapsed, as illustrated in FIG. 5, it is of course also possible to upwardly position the hanger arm 20 to lie flat against the panel. To this end, an upwardly directed force can be applied to the free end portion 24 of the arm 20 in the normal display position so as to dislodge the spaded end 26 from the pocket 38 in an outward arcuate movement as opposed to the upward linear movement previously described, and to cause the bend of the L to pass through the opening 40 such that the arm 20 can be then lie in an upwardly extended position. As shown, the bend of the L abuts the bottom of the pocket 38 and rests thereon in a stable manner.

Figure 6A:
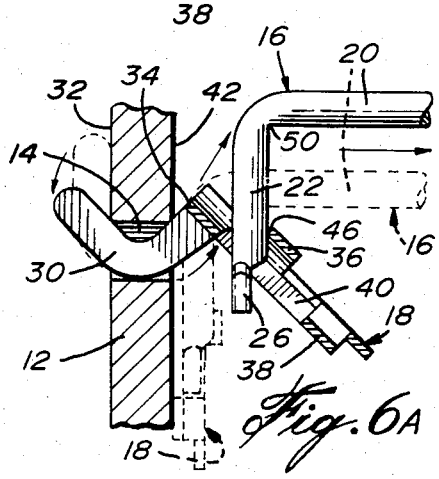

FIGS. 6 and 6A show how the display hanger 10 can be removed from the panel 12 while the hanger arm 20 is maintained substantially perpendicular to the plane of the panel. As illustrated in FIG. 6, the hanger member 16 is first raised to the position shown in broken lines so as to upwardly displace the coupling arm 22 such that the spaded end 26 thereof is dislodged from the pocket 38 and is positioned within the clearing aperture 40. Next, by simply pulling the hanger arm 20 in a direction away from the panel front surface 42 while holding it substantially horizontal, the edge 46 of the lower sleeve portion 36 is caused to abut a portion of the coupling arm 22 and to thereby provide a contact pivot point on the arm 22 about which the mounting plate 18 is articulated, as shown in FIG. 6A. As the lower portion of the plate is swung upwardly, the elliptical opening 48 and central aperture 40 providing the necessary clearance for the arm 22 and its spaded end 26, the hook fingers 30 are withdrawn from the perforations 14 in an arcuate movement resulting in the disengagement of the bracket member 18 from the panel 12. Thus, the hanger member 16 and bracket member 18 cooperate together upon the disengagement of the bracket member from the panel to provide an articulation of the bracket member about a horizontal axis such that the bracket member is released from the panel in an arcuate movement while the hanger arm 20 is maintained substantially perpendicular to the plane of the panel. As is apparent from FIGS. 2 and 3, the spaded end 26 and the elliptical opening 48 are sized relative to one another such that the spaded end 26 is prevented from passing through the opening 48 when the plane of the spaded end extends transversely to the longitudinal axis of the opening 48, and thus acts as a means for retaining the hanger member 16 and the bracket member 18 in engagement with one another upon release of the bracket member 18 from the panel 12.

To mount the display hanger 10 on the panel 12, the hanger arm 20 is held substantially horizontal with the coupling arm 22 loosely engaged within the opening 48, the plane of the spaded end 26 extending transversely to the longitudinal axis of the opening 48 so as to prevent the bracket member 18 from being disengaged from the hanger member 16, and the hook fingers 30 of the bracket member are inserted in an arcuate movement through the perforations 14 causing the mounting plate 18 to swing towards the panel and to lie in a vertical plane. Then, the hanger member 16 is lowered so as to downwardly displace the coupling arm 22 and to thereby press-fit the spaded end 26 in the pocket 38, resulting in the locking of the arm 20 in the display position.

Figure 7:
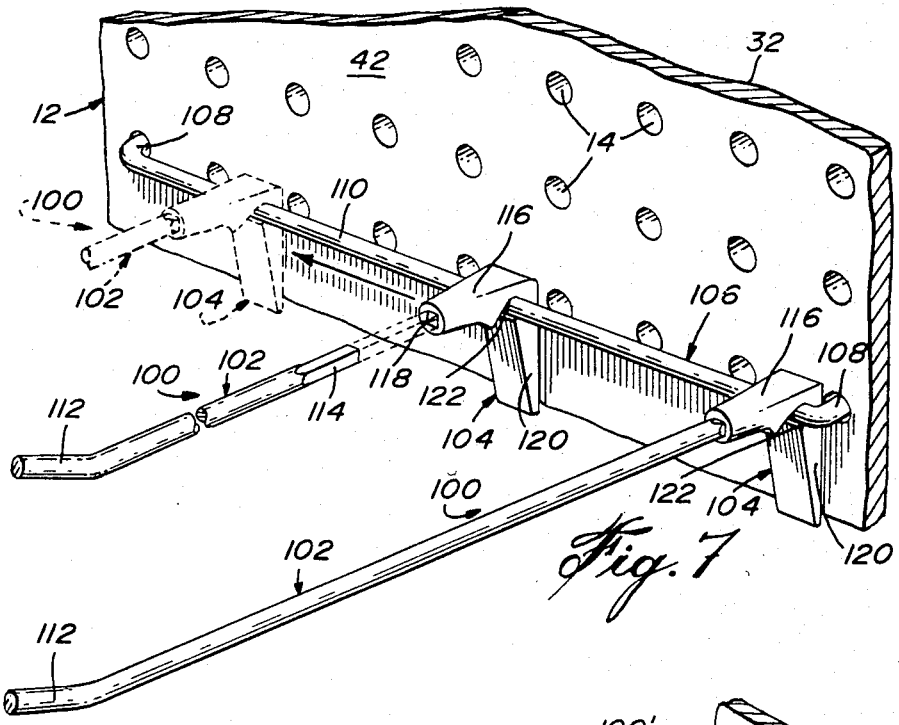
FIG. 7 is a perspective view of another collapsible display hanger according to a second preferred embodiment of the invention, as seen mounted on a display panel in a normal display position, and also showing how the hanger member can be displaced horizontally along the bracket member.
Figure 8:
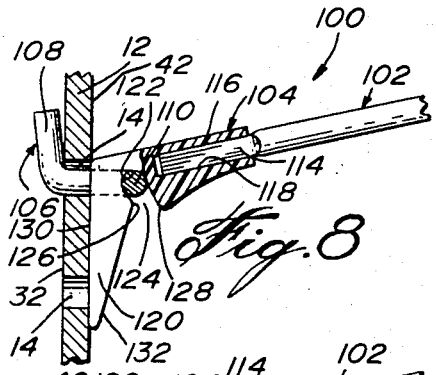
FIGS. 8 and 8A are fragmentary side sectional views of the display hanger of FIG. 7, showing how the hanger member can be disengaged from the bracket member while the latter remains anchored to the panel.
Figure 9:
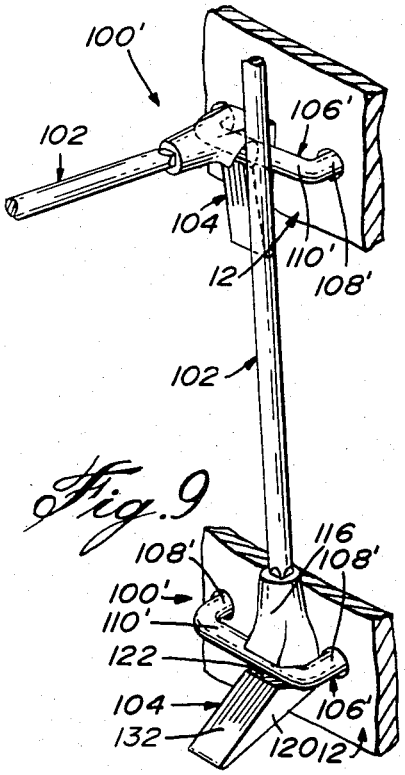
FIG. 9 is still another prespective view showing the hanger arm of the display hanger in the collapsed position and clearing an adjacent unit positioned in the same vertical row.

Turning now to FIGS. 7–9 which illustrate a second preferred embodiment of the invention, there is shown a display hanger which is generally designated by reference numeral 100 and includes a two-piece hanger member comprising a wirelike metallic hanger arm 102 and a connector element 104 to which the hanger arm is detachably connected, the connector element 104 being hingedly connected to a U-shaped wirelike metallic bracket member 106. The connector element 104 may be made of plastic material such as a polycarbonate resin, for example MERLON-50 (trademark). Although the hanger arm 102 is shown as being detachable from the connector element 104, it is apparent that it can also be fixedly connected thereto or even made integral with the connector element 104 provided of course that both parts are constructed of the same material.

The bracket member 106 which is in fact an elongate so-called "bull horn" comprises a pair of spaced parallel upwardly extending L-shaped hook arms 108 adapted for passage through a pair of distant horizontally disposed perforations 14 and abutment against the rear surface 32 of the display panel 12, and an elongate horizontally extending base 110 interconnecting the hook arms 108. The hanger arm 102, on the other hand, has an upwardly bent free end portion 112 and an opposite coupling end portion 114. The connector element 104 has a hanger arm retaining portion 116 provided with a socket 118 extending coextensively with the longitudinal axis of the arm 102 for receiving the coupling end portion 114 in tight-fit engagement, and an abutment leg 120 angularly disposed to the longitudinal axis of the hanger arm 102. The angle defined between the hanger arm retaining portion 116 and abutment leg 120 is slightly greater than 90° such that when a load is carried by the arm 102 the hanger arm retaining portion 116 flexes slightly inwardly to allow the hanger arm to extend substantially perpendicular to the plane of the panel, in the normal display position. The abutment leg 120, in the display position, extends downwardly in abutting engagement with the panel front surface 42 so as to maintain the hanger arm 102 forwardly extended.

As shown, the coupling end portion 114 and socket 118 are square in cross-section so as to prevent the arm 102 from rotating about its longitudinal axis. The hanger arm 102 can thus be conveniently detached from the connector element 104 by simply pulling it out its socket 118 and changed for another of different length, the connector element remaining on the bracket member 106 to serve as a marker indicating the original display position.

The connector element 104 is hingedly connected to the bracket member 106 by means of the hinge socket 122 which is formed at the junction of the hanger arm retaining portion 116 and abutment leg 120 and which receives a portion of the base 110 in slidable snap-fit engagement so as to enable the hanger arm 102 to pivot about a horizontal axis while allowing the connector element 104 to slidably move along the base 110 in a direction parallel with the pivot axis. In order to move the hanger arm 102 from its normal display position to the collapsed position whereat it lies flat against the panel 12, the hanger member 102, 104 is first displaced horizontally to an off-set position on the base 110 relative to an upwardly adjacent unit located in the same vertical row, and then the hanger arm 102 is upwardly swung through an arc of about 50° or slightly less to lie closely adjacent the panel front surface 42 and to occupy the collapsed position represented in FIG. 9, the arm 102 thus clearing the upwardly adjacent unit. FIG. 9 shows that the same horizontal shifting displacement and upward pivotal movement can be achieved with a conventional bracket member or "bull-horn" 106' of much shorter length, the hook arms 108' of which are inserted through a pair of adjacent horizontally disposed perforations 14. As shown, the base 110' of the bracket member 106' is held sufficiently tight within the hinge socket 122 to enable the hanger member 102,104 to rest on the bracket member 106' in a stable manner. It should also be noted, in connection with FIG. 7, that the base 106 has a length sufficient to enable several hanger members 102,104 to be connected thereto and to be displaced relative to one another so as to occupy any desired respective display position, thus allowing one to display the merchandise in horizontal rows which are closely spaced in the vertical direction.

Figure 8A:
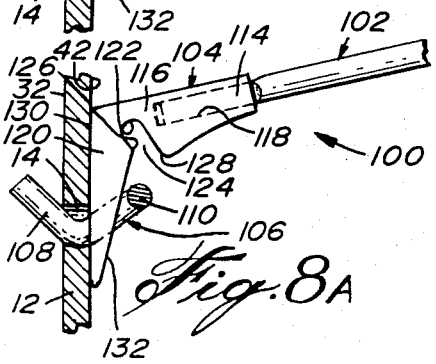

As best shown in FIG. 8, the hinge socket 122 is substantially U-shaped in cross-section and has a forwardly facing mouth opening 124 provided with a pair of opposed lips 126 and 128. The mouth opening 124 defines a resiliently biased restricted passage so as to enable the base 110 of the bracket member 106 to be forcedly removed from or inserted in the hinge socket 112 through the mouth opening 124. The abutment leg 120 is wedge-shaped and has a planar abutment surface 130 which bears against the panel front surface 42 in the normal display position and an opposite surface 132 which tapers from the lip 126 towards the free end of the leg. As shown in FIG. 8A, the lip 126 is spaced from the abutment surface 130 by a distance such as to permit, upon partial disengagement of the bracket member 106 from the panel 12 where the hook arms 108 are disposed in a V-like manner when viewed in the plane of the panel, the base 110 of the bracket member to be forcedly removed from or inserted in the hinge socket 122 by vertically sliding the abutment surface 130 upwardly or downwardly against the panel front surface 42, while maintaining the bracket member 106 anchored to the panel 12. This feature has the advantage of allowing one to remove or add one or more hanger members 102,104 without having to remove the bracket member 106 and to disturb the merchandise displayed by other hanger members connected to the same bracket member.

It is also apparent that, since the base 110 of the bracket member 106 is axially rotatable with the hinge socket 122 and the hook arms 108 can thus be articulated about a horizontal axis relative to the hanger member 102,104, the bracket member can be engaged with or disengaged from the panel 12 in an arcuate movement while the hanger arm 102 is maintained substantially perpendicular to the plane of the panel, in the same manner as described in U.S. Pat. No. 3,275,272.

In summary, by first upwardly displacing the hanger member 16 of the first embodiment illustrated in FIGS. 1–6 and then by horizontally swinging the hanger arm 20 thereof to lie substantially flat against the panel, or by first horizontally displacing the hanger member 102,104 of the second embodiment illustrated in FIGS. 7–9 and then by upwardly swinging the hanger arm 102 thereof to also lie substantially flat against the panel, it is possible to move the hanger arm to the collapsed position while clearing an adjacent unit positioned in the same horizontal or vertical row as the display hanger to be collapsed. The display hanger of the invention thus eliminates the risk of bodily injury and/or of damages to the clothing of passers-by.

I claim:

1. A collapsible display hanger for detachable engagement with a perforated display panel provided with regularly spaced perforations arranged in horizontal and vertical rows, comprising:

a hanger member having an elongate hanger arm adapted to extend outwardly from said panel and substantially perpendicular to the plane thereof, in a normal merchandise display position;

a bracket member adapted to be removably anchored to said panel through a pair of horizontally disposed perforations; and hinge means slidably interconnecting said hanger member with said bracket member for pivotal movement of said hanger arm about a pivot axis between said normal display position and a collapsed position whereat said hanger arm lies closely adjacent said panel, said hanger member being slidably engaged with said bracket member for shifting displacement of said hanger member in a direction parallel with said pivot axis such that said hanger arm clears an adjacent display hanger disposed in the pivotal path thereof when said hanger arm is pivotally moved to said collapsed position, said hanger member and said bracket member cooperating together upon disengagement of said bracket member from said panel to provide an articulation of said bracket member about a horizontal axis such that said bracket member is released from said panel in an arcuate movement when said hanger arm is pulled away from said panel while being maintained substantially perpendicular to the plane thereof, said hanger member including means which cooperates with said bracket member for retaining said hanger member and said bracket member in engagement with one another upon release of said bracket member from said panel, while permitting said shifting displacement of said hanger member.

2. A display hanger as claimed in claim 1, wherein said hanger member is L-shaped and includes a coupling arm disposed at substantially right angle to said hanger arm and wherein said bracket member comprises a mounting plate provided with anchoring means at an upper portion thereof, said hinge means comprising a pair of upper and lower sleeve portions arranged on said mounting plate for engaging said coupling arm on opposite sides thereof so as to enable said hanger arm to pivot about a vertical axis while allowing said coupling arm to slidably move along said vertical axis whereby said hanger member is moved from said normal display position to said collapsed position by upwardly displacing said hanger member and horizontally swinging said hanger arm to lie closely adjacent said panel, said sleeve portions being disposed relative to one another such that upon disengagement of said mounting plate from said panel an edge of said lower sleeve portion abuts a portion of said coupling arm whereby to permit said mounting plate to be articulated about said coupling arm portion, said display hanger further including means for releasably locking said hanger member in said normal display position.

3. A display hanger as claimed in claim 1, wherein said elliptical opening is inclined at an angle of about 45°, when viewed in the plane of said mounting plate.

4. A display hanger as claimed in claim 1, wherein said releasable locking means comprise a spaded end at a free end portion of said coupling arm and a rearwardly protruding pocket formed in said mounting plate below said lower sleeve portion and having a complementary shape to receive said spaded end in press-fit engagement, said mounting plate being provided with an aperture between said lower sleeve portion and said pocket for clearing said spaded end when disengaged from said pocket, and wherein said spaded end and said elliptical opening are sized relative to one another such that said spaded end is prevented from passing through said opening when the plane of said spaded end extends transversely to the longitudinal axis of said opening whereby said spaded end acts as said means for retaining said hanger member and said bracket member in engagement with one another.

5. A display hanger as claimed in claim 4, wherein said spaded end is disposed such that the plane thereof lies parallel with the plane of said mounting plate when said hanger member is in said normal display position.

6. A display hanger as claimed in claim 5, wherein said elliptical opening has a length sufficient to allow passage of said spaded end when the plane of said spaded end is aligned with the longitudinal axis of said opening, and to thereby permit said coupling arm to be removed from or inserted through said sleeve portions while maintaining said mounting plate anchored to said panel.

7. A display hanger as claimed in claim 4, wherein said anchoring means comprises a pair of spaced parallel rearwardly and upwardly extending L-shaped hook fingers adapted for passage through said horizontal perforations and abutment against a rear surface of said panel.

8. A display hanger as claimed in claim 7, wherein said upper sleeve portion and said pocket abut against a front surface of said panel such that said mounting plate hangs from said front surface in a spaced relationship thereto, and wherein a right angularly bent inner junction portion is defined between said coupling arm and said hanger arm, a respective portion of said hook fingers adjacent said mounting plate together with an upper edge portion of said mounting plate on either side of said upper sleeve portion defining a resting abutment for supporting said hanger arm in said collapsed position.

9. A display hanger as claimed in claim 1, wherein said hanger member further has a connecting end portion comprising an abutment leg angularly disposed to said hanger arm and wherein said bracket member is U-shaped and includes a pair of spaced parallel upwardly extending L-shaped hook arms adapted for passage through said horizontal perforations and abutment against a rear surface of said panel and a horizontally extending base interconnecting said hook arms, said hinge means comprising a hinge socket formed at said connecting end portion of said hanger member and receiving a portion of said base in slidable snap-fit engagement so as to enable said hanger arm to pivot about a horizontal axis while allowing said connecting end portion to slidably move along said base in a direction parallel with said horizontal axis whereby said hanger arm is moved from said normal display position whereat said abutment leg downwardly extends in abutting engagement with a front surface of said panel to maintain said hanger arm forwardly extended, to said collapsed position whereat said leg is disengaged from said front surface by horizontally displacing said hanger member and upwardly swinging said hanger arm to lie closely adjacent said panel, said base portion being axially rotatable within said hinge socket when said bracket member is engaged with or disengaged from said panel whereby to permit said bracket member to be articulated relative to said hanger member, said hinge socket acting as said means for retaining said hanger member and said bracket member in engagement with one another.

10. A display hanger as claimed in claim 9, wherein said hinge socket is substantially U-shaped in cross-section and has a forwardly facing mouth opening provided with a pair of opposed lips and defining a resiliently biased restricted passage so as to enable said base portion of said bracket member to be forcedly removed from or inserted in said hinge socket through said mouth opening.

11. A display hanger as claimed in claim 10, wherein one of said lips is defined in said leg and wherein said leg is wedge-shaped and has a planar abutment surface adapted to bear against the panel front surface in said normal display position and an opposite surface tapering from said one lip towards a free end of said leg, said one lip being spaced from said abutment surface by a distance such as to permit, upon partial disengagement of said bracket member from said panel where said hook arms are disposed in a V-like manner when viewed in the plane of said panel, said base portion of said bracket member to be forcedly removed from or inserted in said hinge socket by vertically sliding said abutment surface upwardly or downwardly against the panel front surface while maintaining said bracket member anchored to said panel.

12. A display hanger as claimed in claim 9, wherein said connecting end portion of said hanger member further includes a hanger arm retaining portion which together with said abutment leg form a separate connector element, said hanger arm being detachably connected to said hanger arm retaining portion of said connector element.

13. A display hanger as claimed in claim 12, wherein said hanger arm has an upwardly bent free end portion and an opposite coupling end portion and wherein said hanger arm retaining portion is provided with a socket extending coextensively with the longitudinal axis of said hanger arm for receiving said coupling end portion in tight-fit engagement, said coupling end portion and said socket cooperating to prevent said hanger arm from rotating about its longitudinal axis.

14. A display hanger as claimed in claim 9, wherein said base of said bracket member has a length sufficient to enable at least two hanger members to be connected thereto and be displaced relative to one another so as to occupy any desired respective display position.

15. A collapsible display hanger for detachable engagement with a perforated display panel provided with regularly spaced perforations arranged in horizontal and vertical rows, comprising:

a L-shaped hanger member having an elongate hanger arm and a coupling arm disposed at substantially right angle to said hanger arm, said hanger arm being adapted to extend outwardly from said panel and substantially perpendicular to the plane thereof, in a normal merchandise display position;

a bracket member adapted to be removably anchored to said panel through a pair of horizontally disposed perforations, said bracket member comprising a mounting plate provided with anchoring means at an upper portion thereof;

hinge means slidably interconnecting said hanger member with said bracket member for pivotal movement of said hanger arm between said normal display position and a collapsed position whereat said hanger arm lies closely adjacent said panel, said hinge means comprising a pair of upper and lower sleeve portions integrally formed in said mounting plate and protruding respectively rearwardly and forwardly therefrom for engaging said coupling arm on opposite sides thereof so as to enable said hanger arm to pivot about a vertical axis while allowing said coupling arm to slidably move along a vertical axis whereby said hanger member is moved from said normal display position to said collapsed position by upwardly displacing said hanger member and horizontally swinging said hanger arm to lie closely adjacent said panel, thereby clearing an adjacent display hanger disposed in the pivotal path of said hanger arm as said hanger arm is pivotally moved to said collapsed position; said sleeve portions being disposed relative to one another such that upon disengagement of said mounting plate from said panel an edge of said lower sleeve portion abuts a portion of said coupling arm whereby to permit said mounting plate to be articulated about said coupling arm portion and thereby allow said bracket member to be released from said panel in an arcuate movement while said hanger arm is maintained substantially perpendicular to the plane of said panel; said sleeve portions having complementary contoured edges defining an angularly inclined elliptical opening having a longitudinal axis, when viewed facing said mounting plate, for clearing said coupling arm when said mounting plate is articulated about said coupling arm portion upon disengagement thereof from said panel;

means for releasably locking said hanger member in said normal display position; and means for retaining said hanger member and said bracket member in engagement with one another upon release of said bracket member from said panel, while permitting said upward displacement of said hanger member.

* * * * *